United States Patent [19]

Walters

[11] 3,998,138

[45] Dec. 21, 1976

[54] MAILING DEVICE

[76] Inventor: Aaron Walters, 10 Coral Lane, East Northport, N.Y. 11731

[22] Filed: May 5, 1975

[21] Appl. No.: 574,412

Related U.S. Application Data

[63] Continuation-in-part of Ser. No. 458,807, April 8, 1974, abandoned.

[52] U.S. Cl. ..... 93/61 R; 53/31; 93/62

[51] Int. Cl.[2] ..... B31B 49/04

[58] Field of Search ..... 53/31, 206; 93/61 R, 93/62, 63 M, 63 R; 229/69

[56] References Cited

UNITED STATES PATENTS

| | | | |
|---|---|---|---|
| 3,374,940 | 3/1968 | Allison | 93/61 R |
| 3,557,519 | 1/1971 | Lyon, Jr. | 53/31 |
| 3,845,698 | 11/1974 | Scholle | 53/31 X |
| 3,902,655 | 9/1975 | Huffman | 229/69 |

*Primary Examiner*—James F. Coan
*Attorney, Agent, or Firm*—Edith Grill

[57] ABSTRACT

A method of forming a mailing device from a previously printed form, said form including a letter sheet and an envelope sheet, and a plurality of widely spaced self-breakable teats joining said letter sheet to said envelope sheet comprising the steps of forming a plurality of widely spaced self-breakable teats at the transverse line joining the letter sheet to the envelope sheet, folding said letter sheet to a size of less than half of said envelope sheet, folding said folded letter sheet onto said envelope sheet, folding said envelope sheet to enclose said letter sheet, and sealing said envelope sheet.

6 Claims, 8 Drawing Figures

FIG. 1
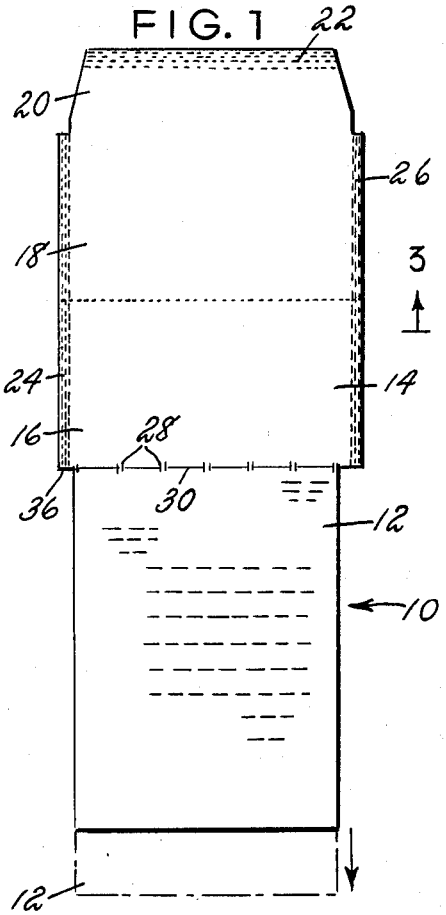
FIG. 2
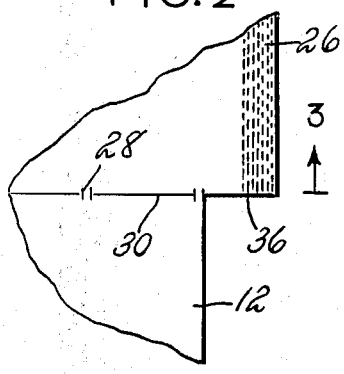
FIG. 3
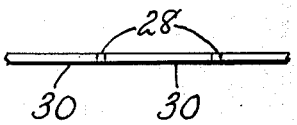
FIG. 4
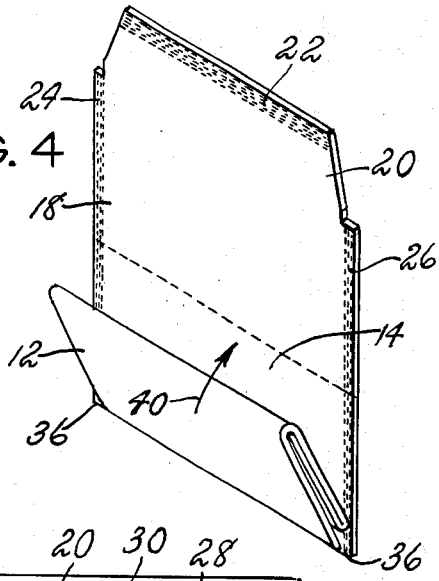
FIG. 5
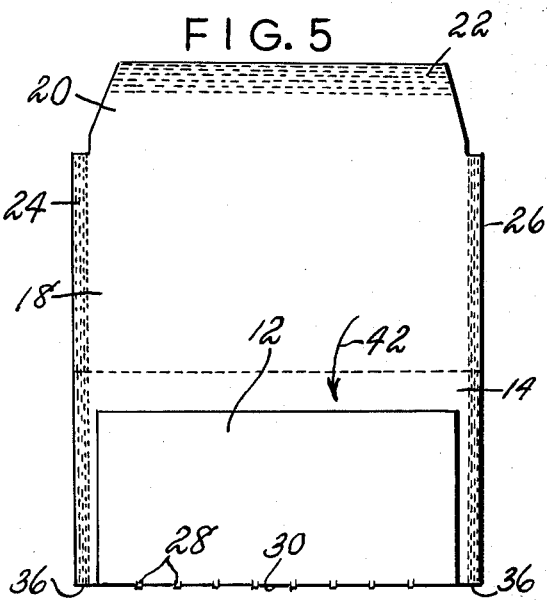
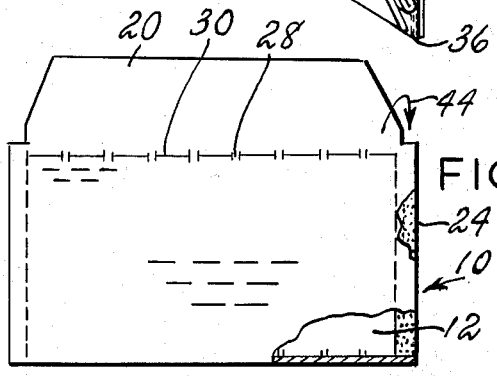
FIG. 6
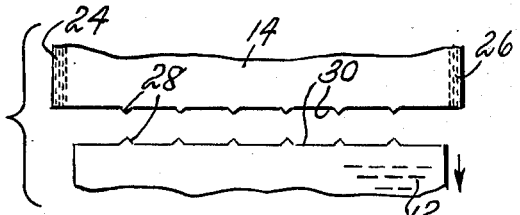
FIG. 8
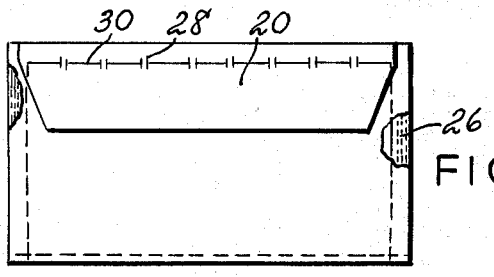
FIG. 7

MAILING DEVICE

This is a continuation-in-part patent application Ser. No. 458,807, filed Apr. 8th, 1974, and now abandoned.

Aforesaid copending patent application relates to an integral letter-envelope sheet connected by widely spaced connectors which are self-breakable.

BACKGROUND OF THE INVENTION

1. Field of the Invention

This invention relates to a mailing device and to the method of forming said mailing device, and more particularly to a one-piece form for use as a letter sheet and envelope.

2. Description of the Prior Art

Various types of combination letter sheets and envelopes have been devised in the past, such as that disclosed in Harson U.S. Pat. No. 1,801,155, wherein a combined envelope and letter sheet is formed from a blank in the shape of a single sheet of material having triangular shaped gussets extending from opposite sides of the envelope portion of the sheet; said blank being provided with slits leaving narrow connections at the juncture of said letter sheet and envelope for convenience in servering the letter sheet by recipient. U.S. Pat. No. 3,557,519 to Lyon discloses a letter sheet which is first folded into overlying position relative to an envelope sheet which is then folded to enclose the letter sheet, after which the letter sheet is separated from the envelope prior to sealing. In this patent there is disclosed the use of perforations for separating the letter sheet from the mailing sheet. However, these perforations require a special step for parting the letter sheet from the envelope before the mailing device is sealed, i.e., by slitting. Other mailing devices in the prior art useful for multiple mailing of notices, letters, advertising material and the like require the addressee to separately detach the letter from the envelope by ripping along perforations, thereby making the mailing device untasteful and undesirable.

SUMMARY OF THE PRESENT INVENTION

The present invention has for its object the provision of a mailing device in the form of a letter sheet which is connected to an envelope by means of self-breakable connectors wherein the letter sheet is folded relative to the envelope and sealed. Subsequent handling will cause the parting of the letter sheet from the envelope so that the addressee will receive a mailing piece where the letter is separately folded and received in the envelope as a discrete element from the envelope requiring no separation or tearing and, therefore, being tasteful and desirable. Heretofore, a perforated or scored line was used between the envelope and letter, which necessitated the positive act of separation by the recipient. Applicant has devised a "mailer" which combines the advantages of an attached letter-envelope, particularly useful in the processing of computerized mail, with the advantages of a separated letter-envelope mailing. Applicant's mailing device retains the letter-envelope in an attached condition during the folding and sealing operations, whereby the processing thereof is expedited. In addition, it eliminates the unsightly and undesirable act of separating or tearing the letter at the envelope junction, heretofore unattainable with prior art perforations or other narrow connections. Applicant's novel mailing device has enabled computerized mail to have the appearance of personalized mail without resorting to expensive and complicated machinery and methods.

Applicant has solved a problem of long standing in the processing of computerized mail by the use of widely spaced, frangible teats or connectors at the letter-envelope junction which are self-breakable during the normal handling of the mail.

More specifically, my invention relates to a sealed mailing device formed from an integral sheet comprising a letter sheet and an envelope, a plurality of widely spaced, self-breakable teats joining said letter sheet to said envelope, the distance between said teats being at least ten times the width of said tests, said teats having a tensile strength sufficient to retain the letter attached to the envelope during the folding operation (and stuffing operation which is optional) but frangible enough to allow them to break during subsequent handling (i.e., stacking, stamping, etc.), whereby said letter sheet separates itself from said envelope.

The use of the widely spaced frangible teats serves the dual function of securely retaining said letter sheet in properly aligned position within the envelope and allows for the insertion of additional material in the form of letters, cards and the like into the envelope prior to sealing. A particular advantage hereof is the formation of a discrete letter which occurs subsequent to sealing and during the normal handling of said mail, without resorting to additional and/or costly procedural steps.

The method of forming the mailing device of instant invention from a previously printed form, said form including a letter sheet and an envelope sheet and a plurality of widely spaced self-breakable teats joining said letter sheet to said envelope sheet is particularly adapted to the process of converting unprocessed computerized printouts into integral envelope-letter combinations.

The printed form, which may be on paper of any size and/or weight, is die-cut into the appropriate shape for a letter-envelope combination, preferably having straight longitudinal edges, with the letter sheet being of less width than the envelope, simultaneously with the formation of teats at the letter-envelope junction. Although both operations are preferably performed simultaneously, each operation can be separately performed. The paper may be held flat and in position for this operation by any suitable means such as sprocket holes or the like. A cross cutting bar per se or in conjunction with the die-cutting device is adjusted to form the desired number and width of teats, which is dependent on, and is a function of, the weight and size of the paper. Accordingly, the number of teats for the average 7 inches letter may vary from about four to 10, depending on both the particular paper utilized and the width of said teat. It has been ascertained that the distance between said teats must be at least ten times the width of said teats in order to obtain the proper degree of frangibility capable of retaining the letter attached during the folding and sealing operation in an automated folding machine, but breakable during the subsequent handling thereof.

It has been found that a letter 7 inches wide on 60 pound paper requires about five to 10 teats, 1/16th inch wide. Increasing the width of the letter to 8 inches increases the range to about 12 teats. Decreasing the width of the letter to 3 inches reduces the number of teats to about 3 to 4. Thus, it is apparent that the size of the letter is an essential factor in determining the number of teats.

Another factor which influences the number of teats is the weight of the paper. A 30 pound paper requires less teats than a 70 pound paper.

Still another factor which affects the number of teats is the size thereof, which may vary between about 1/32 to 3/32 of an inch and is preferably about 2/32 to 3/32 of an inch.

Accordingly, it has been ascertained that the distance between the widely spaced teats be at least ten times the width of said teat in order to effectively retain the letter attached to the envelope during the folding, stuffing and sealing thereof, and be frangible enough to break during the subsequent handling thereof, whereby the letter is separated from the envelope prior to receipt by recipient.

It is therefore an object of the invention to provide a mailing device containing self-breakable connectors at the transverse line between the letter sheet and envelope in which the letter sheet is separately folded to fall within said envelope sheet, said envelope sheet is folded around said folded letter sheet to form an envelope, and said integral flap is sealed, as occurs during automatic operation of a folding machine to form a completed mailing piece; said self-breakable connectors being capable of retaining the letter sheet attached to the envelope during the folding and sealing process and frangible enough to break during subsequent handling so that the letter sheet is substantially completely separated from the envelope.

Still further objects and features of the invention reside in the provision of a mailing device that is simple in construction and manufacture, capable of being made by various existing printing, folding and glueing machines, which is attractive in appearance, and which is inexpensive to employ thereby permitting wide use and distribution.

These, together with the various ancillary objects and features of the invention which will become apparent as the following description proceeds, a preferred embodiment being shown in the accompanying drawing, by way of example only, wherein:

FIG. 1 is a plan view of the form used in a mailing device in accordance with the concepts of the invention;

FIG. 2 is an enlarged partially plan view of elements of the invention;

FIG. 3 is an enlarged sectional view taken along the plane of line 3—3 in FIG. 2;

FIG. 4 is an perspective view showing the mailing device in an intermediate stage of folding;

FIG. 5 is a plan view showing the envelope with the letter sheet folded;

FIG. 6 is a partial plan view in the other side of the mailing device after the envelope has been partially folded;

FIG. 7 is a plan view of the complete mailing device after folding and sealing, with parts being broken away showing other parts in section; and FIG. 8 shows the separation of the letter sheet from the envelope.

With continuing reference to the accompanying drawing wherein like reference numerals designate similar parts throughout the various views, reference numeral 10 generally designates an integral mailing device constructed in accordance with the present invention. This mailing device 10 includes a letter sheet 12 and envelope sheet 14 preferably die-cut from a printed blank. The letter sheet 12 is of less width than the envelope sheet 14 forming shoulders as at 36.

The envelope sheet 14 forms an envelope when folded and includes half sections 16 and 18 and a flap 20. The flap 20 is provided with an adhesive coating 22, as are the sides of the envelope sheet as at 24 and 26.

Suitable indicia such as a letter, or advertising indicia, is printed on the letter sheet and the envelope is addressed. The letter sheet 12 is integrally connected to the envelope sheet 14 by plurality of teats 28 or connectors which are widely spaced from each other at 30. The spaces 30 are at least 10 times the width of the connectors 28. These connectors 28 which are formed prior to the folding operation, will remain intact during the folding of the letter sheet 12 relative to the envelope sheet 14 as shown by the arrow 40 in FIG. 4, and until sealed as in FIG. 7. Teats 28 hold letter sheet 12 in position within envelope 14 and facilitate the insertion of additional letter sheets when and as needed or desired. It is to be noted that the folding may be done automatically by machinery, and preferably hot glue and/or pressure sensitive adhesive is applied for sealing purposes. After the letter sheet 12 has been folded as shown in FIG. 5, the envelope sheet is folded in half in the direction of arrow 42 to enclose the letter sheet, with the adhesive coating 24 and 26 sealing the edges of the envelopes after which the flap is folded as shown by arrow 44 to form the completed mailing device shown in FIG. 7. The mailing piece is then in the form an an envelope with attached letter therein, the letter sheet 12 being separated from the envelope during the normal post-handling thereof, such as stacking stamping, shipping, and the like.

A latitude of modification, substitution and change is intended in the foregoing disclosure, and in some instances some features of the present invention may be employed without a corresponding use of other features.

What is claimed is:

1. A method of forming a mailing device consisting of an envelope containing a separate letter sheet from a preprinted integral form comprising a letter sheet and an envelope sheet joined along a transverse line which comprises:

a. cutting said pre-printed form into an integral letter-envelope combination with an integral flap, b. forming a plurality of self-breakable teats at the transverse line joining the letter sheet to the envelope sheet, the distance between the teats being at least ten times the width of said teats, c. folding said letter sheet to lie within said envelope sheet, d. folding the said envelope sheet around said folded letter sheet to enclose said letter sheet and form an envelope, e. folding and closing said integral flap to form a folded and sealed mailing device, f. subsequent handling of said folded and sealed mailing device so as to result in separation of said letter sheet from said envelope, before said mailing device is opened.

2. The method according to claim 1, wherein said envelope sheet is sealed on its sides by bonding simultaneously with the folding thereof.

3. The method of claim 1, wherein additional material is inserted into the envelope prior to closing said flap.

4. The method according to claim 1, wherein said pre-printed form is cut into a shape such that said letter sheet is of less width than said envelope sheet.

5. The method of claim 4, wherein said pre-printed form is cut into a shape having straight longitudinal edges simultaneously with the formation of the self-breakable teats.

6. The method of claim 1 wherein the width of each teat is about 1/32 to 3/32 of an inch.

* * * * *